United States Patent [19]

Salberg et al.

[11] Patent Number: 4,986,693

[45] Date of Patent: Jan. 22, 1991

[54] ROADWAY WATER DRAINAGE INSTALLATION

[75] Inventors: David B. Salberg, Kempton Park; Albert Rooseboom, Pretoria, both of South Africa

[73] Assignee: Salberg Concrete Products (Proprietary) Ltd., Pretoria, South Africa

[21] Appl. No.: 431,889

[22] Filed: Nov. 6, 1989

[30] Foreign Application Priority Data

Nov. 7, 1988 [SA] Saudi Arabia ..... 88/8328
Dec. 9, 1988 [SA] Saudi Arabia ..... 88/9250

[51] Int. Cl.[5] ..... E01C 11/22

[52] U.S. Cl. ..... 404/4; 404/2; 404/98

[58] Field of Search ..... 404/2, 3, 4, 5, 26, 404/98, 7–8; 52/3, 4; 249/2, 8

[56] References Cited

U.S. PATENT DOCUMENTS 1,471,819 10/1923 Bauschard ..... 404/5
2,354,994 8/1944 Holland ..... 404/5
4,367,974 1/1983 Beanland ..... 404/5
4,454,039 6/1984 McCoy ..... 404/4
4,838,727 6/1989 Capuano ..... 404/4

*Primary Examiner*—Ramon S. Britts
*Assistant Examiner*—Roger J. Schoeppel
*Attorney, Agent, or Firm*—Cushman, Darby & Cushman

[57] ABSTRACT

A roadway drainage installation comprising a roadway, an elevated pavement extending alongside the roadway, and a more or less horizontal apron extending alongside the roadway so that it is located between the roadway and the pavement at the level of the roadway. A curb extends upwardly from the apron to the pavement so that the apron and curb define between them a water pathway. A storm water conduit runs below the pavement, the apron and the roadway. A curb inlet device comprises an opening in the apron as well as an opening in the curb, with the openings being in communication with each other. The curb inlet device is connected to the storm water conduit such that water can pass from the water pathway, through the openings into the storm water conduit. Water-deflecting members are located in the apron opening. The water-deflecting members have primary water-deflecting surfaces for deflecting water into the curb opening at an acute angle to the curb, as well as a secondary water-deflecting surfaces for simultaneously deflecting water downwardly.

11 Claims, 3 Drawing Sheets

ROADWAY WATER DRAINAGE INSTALLATION

This invention relates to a roadway water drainage installation. It relates also to a grid device for such an installation, to a drainage member for such an installation, and to a method of draining water into the water channel of such a system.

The Applicant is aware of a roadway water drainage system which comprises a roadway; an elevated pavement extending alongside the roadway; a more or less horizontal apron extending alongside the roadway so that it is located between the roadway and the pavement at the level of the roadway; a curb extending upwardly from the apron to the pavement so that the apron and curb define between them a water pathway; a storm water conduit running below the pavement and/or the apron and/or the roadway; and a curb inlet device comprising an opening in the apron as well as an opening in the curb, with the openings being in communication with each other and with the device being connected to the storm water conduit, such that water can pass from the water pathway, through the openings into the storm water conduit. Such a roadway drainage system is hereinafter also referred to as 'a roadway drainage system of the kind described'.

In practice, a grid having grid members extending parallel to the curb as well as orthogonally thereto so that they define a plurality of rectangular grid openings, spans the apron opening. However, such an arrangement has the drawback that water flowing along the pathway often passes over the grid and past the curb opening, especially at high water flow rates, e.g. supercritical water flow rates, without sufficient water passing downwardly through the grid openings and sideways through the curb opening, resulting in ineffective water drainage.

It is hence an object of the invention to provide a grid device for such a roadway drainage system whereby this drawback is at least reduced.

According to a first aspect of the invention, there is provided a grid device locatable in the apron opening of a roadway drainage system of the kind described, the grid device comprising at least one elongate support; and a plurality of water-deflecting members spaced apart along the support and protruding therefrom, the members being arranged such that water passing over the grid device enters the gaps between adjacent water-deflecting members and is deflected both downwardly as well as away from the support.

The water-deflecting members may be of elongate form and extend parallel to one another as well as at an obtuse angle to the support. Each member may have a primary water-deflecting surface which extends at said obtuse angle to the support, so that the primary water-deflecting surfaces hence extend parallel to one another, as well as a secondary water-deflecting surface extending transversely to the primary water deflecting surface so that all the secondary water-deflecting surfaces lie in the same plane. The obtuse angle which the primary water-deflecting surfaces form with the support may be between 100° and 160°, e.g. between 120° and 150°.

The grid device may include a further or second elongate support or brace to which the water-deflecting members are mounted, the further or second elongate support being spaced from the other or first support.

The device may also include a cover plate spanning the gap between the supports on the operatively undersides of the water-deflecting members, so that water entering the gaps between the water-deflecting members will pass along the cover plate away from the first support.

According to a second aspect of the invention, there is provided a roadway drainage installation, which comprises a roadway;

an elevated pavement extending alongside the roadway;

a more or less horizontal apron extending alongside the roadway so that it is located between the roadway and the pavement at the level of the roadway;

a curb extending upwardly from the apron to the pavement so that the apron and curb define between them a water pathway;

a storm water conduit running below the pavement and/or the apron and/or the roadway;

a curb inlet device comprising an opening in the apron as well as an opening in the curb, with the openings being in communication with each other and with the device being connected to the storm water conduit such that water can pass from the water pathway, through the openings into the storm water conduit; and at least one water-deflecting member located in the apron opening, the water-deflecting member having a primary water-deflecting surface for deflecting water into the curb opening at an acute angle to the curb, as well as a secondary water-deflecting surface for simultaneously deflecting water downwardly.

The installation may comprise at least one elongate support located within the apron opening and extending along one side of the apron opening; and a plurality of the water-deflecting members spaced apart along the support and protruding from the support so as to span the apron opening.

The upper edges of the water-deflecting members may be at about the same level as the apron.

As mentioned hereinbefore, the water-deflecting members may be of elongate form and extend parallel to one another as well as at an obtuse angle to the support, with the primary water deflecting surfaces of the members hence also extending at said obtuse angle to the support and parallel to one another, and their secondary water-deflecting surfaces extending transversely to their primary water deflecting surfaces so that all the secondary water-deflecting surfaces lie in the same plane. As also mentioned hereinbefore, the obtuse angle which the primary water-deflecting surfaces form with the support may be between 100° and 160°. In other words, the primary water-deflecting surfaces extend at acute angles of between 20° and 70° to the curb. The support and water-deflecting members hence constitute a grid device.

The grid device may include a plurality of spaced transverse supports protruding from the elongate support, with the water-deflecting members being mounted to the transverse supports and the inner or free ends of the transverse supports located on components of the channel so that the grid device is located removably in position.

As mentioned hereinbefore, the grid device may also include a further or second elongate support extending alongside and spaced from the other or first elongate support, and on which the water-deflecting members are also mounted with a set of outer ends of the water-deflecting members located towards the outer edge of the apron opening, and a set of inner ends thereof are located within the channel.

A cover plate may, as also mentioned hereinbefore, span the undersides of the water-deflecting members between the elongate support.

The installation may include at least one elongate drainage member extending transversely to the water pathway, the drainage member comprising an elongate water channel leading into the curb inlet device and located below the roadway surface, and at least one inlet to the water channel through which water passing along the roadway surface can enter into the water channel, flow along the water channel, into the curb inlet device, and hence into the storm water conduit.

The inlet to the water channel may extend along substantially the entire length of the water channel, so that it is defined between a leading edge of the drainage member which water flowing along the roadway surface will encounter first, and a trailing edge spaced from the leading edges. The installation may then include a water-deflecting device in the inlet to the water channel. The water-deflecting device may comprise a lip protruding from the trailing edge so as to span a portion of the inlet.

The installation may include an elongate recess in, and extending along, the curb, the one end of the recess being in communication with the curb opening, and the recess being located at the level of the apron such that some water flowing along the pathway will enter the recess, flow along the recess, and be discharged from the recess into the curb inlet device.

The curb may comprise a plurality of elongate curb units, typically pre-formed from cementitious material, located end-to-end with one end of one of the units abutting against the curb inlet device. The recess will hence be provided in at least the curb unit abutting against the curb inlet device. However, if desired, it can also be provided in at least one further unit.

The unit having the recess may comprise an elongate base portion, an elongate top portion spaced from and extending parallel to the base portion, and an elongate connecting portion connecting the base and top portions such that the recess is defined between the base portion, the top portion and the connecting portion.

According to a third aspect of the invention, there is provided a drainage member for use with a roadway drainage system of the kind described, the drainage member comprising water channel defining means locatable below the roadway surface of a roadway drainage system of the kind described and defining an elongate water channel; and at least one inlet to the water channel, the inlet extending along substantially the entire length of the water channel and being defined between spaced longitudinally extending edges of the water channel defining means.

The water channel defining means may be of settable cementitious material, and may be a moulding or casting thereof. As mentioned hereinbefore, the drainage member may include a water-deflection device in the inlet, and the water-deflection device may comprise a lip protruding inwardly from the one edge defining the inlet.

According to a fourth aspect of the invention, there is provided a method of draining water into the water channel of a roadway drainage system of the kind described, which comprises simultaneously deflecting water flowing across the apron opening of the system inwardly towards the opening in the curb as well as downwardly.

The deflection of the water may be effected by allowing the water to impinge against a plurality of spaced deflecting members or baffles extending at an acute angle to the curb. The method may hence include allowing the water to impinge against a plurality of the baffles extending parallel, and spaced from, to one another.

The method may further include allowing the water to flow inwardly along the baffles from the outer edge of the apron opening for some distance before allowing it to drop below the level of the baffles.

The invention will now be described by way of example, with reference to the accompanying diagrammatic drawings.

IN THE DRAWINGS

Figures 1, 2:
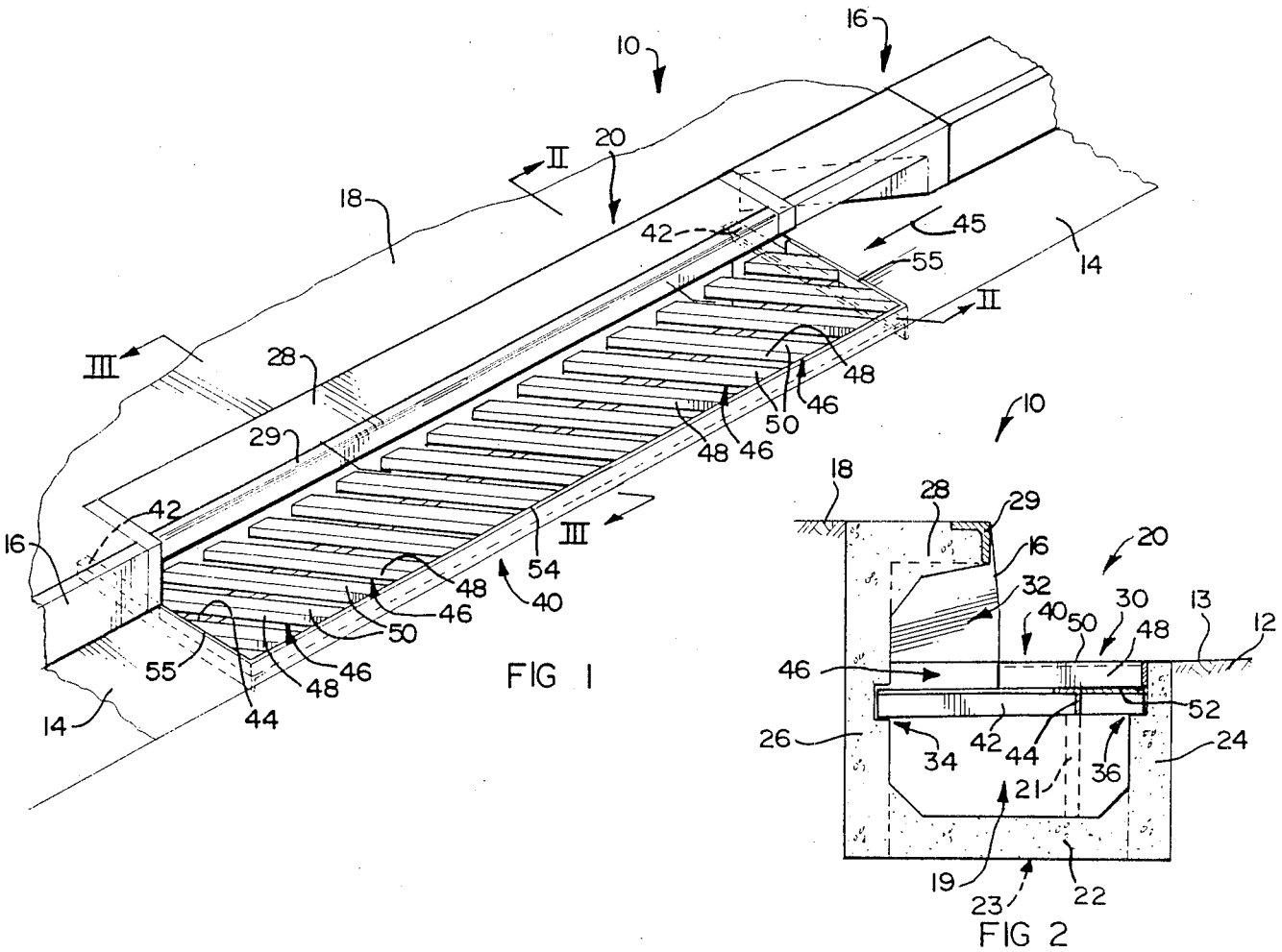
FIG. 1 shows a three-dimensional view of a roadway water drainage installation according to one embodiment of the second aspect of the invention.
FIG. 2 shows a sectional view through II—II in FIG. I.
Figure 3:
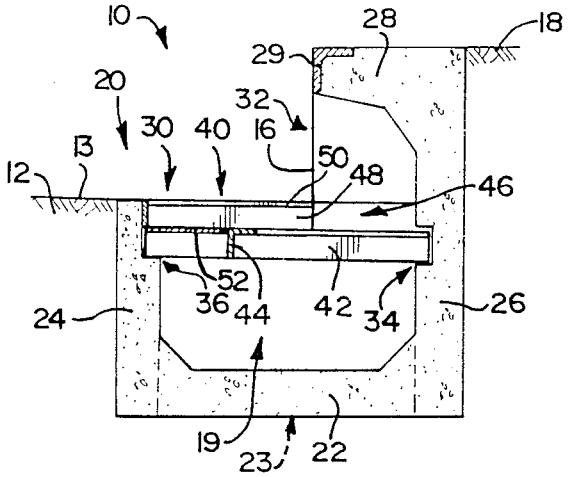
FIG. 3 shows a sectional view through III—III in FIG. 1.
Figure 5:
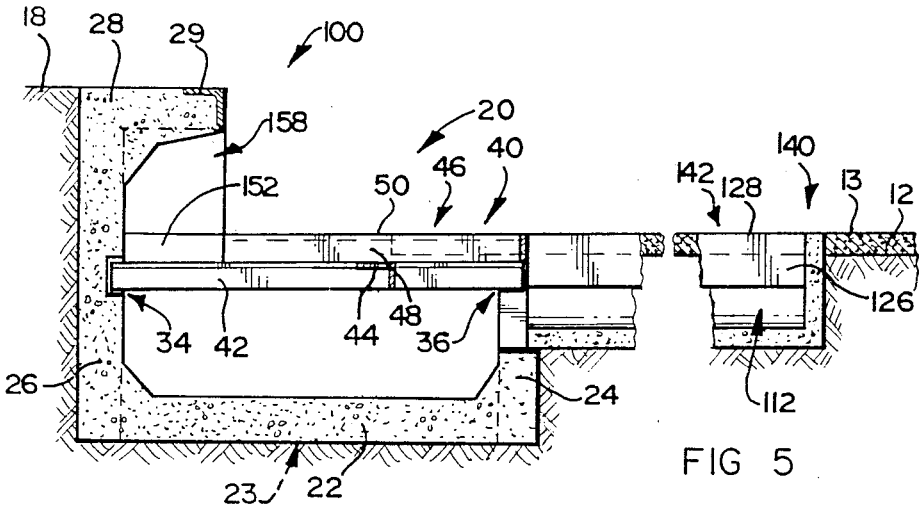
FIG. 5 shows a sectional view through V—V in FIG. 4.
Figure 6:
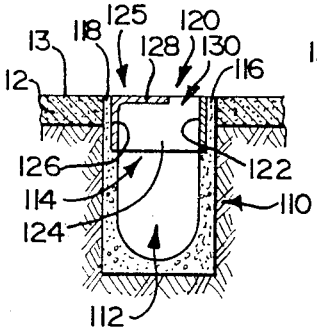
FIG. 6 shows a sectional view through VI—VI in FIG. 4.
Figure 7:
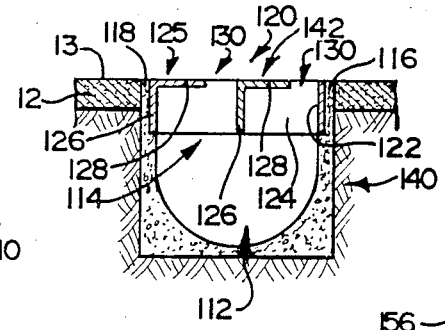
FIG. 7 shows a sectional view through VII—VII in FIG. 4.
Figure 8:
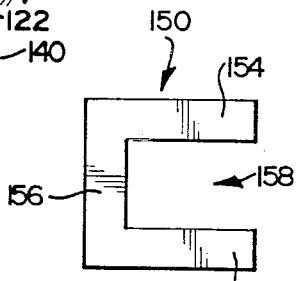
FIG. 8 shows an end view of one of the curb units of FIG. 4.
Figure 4:
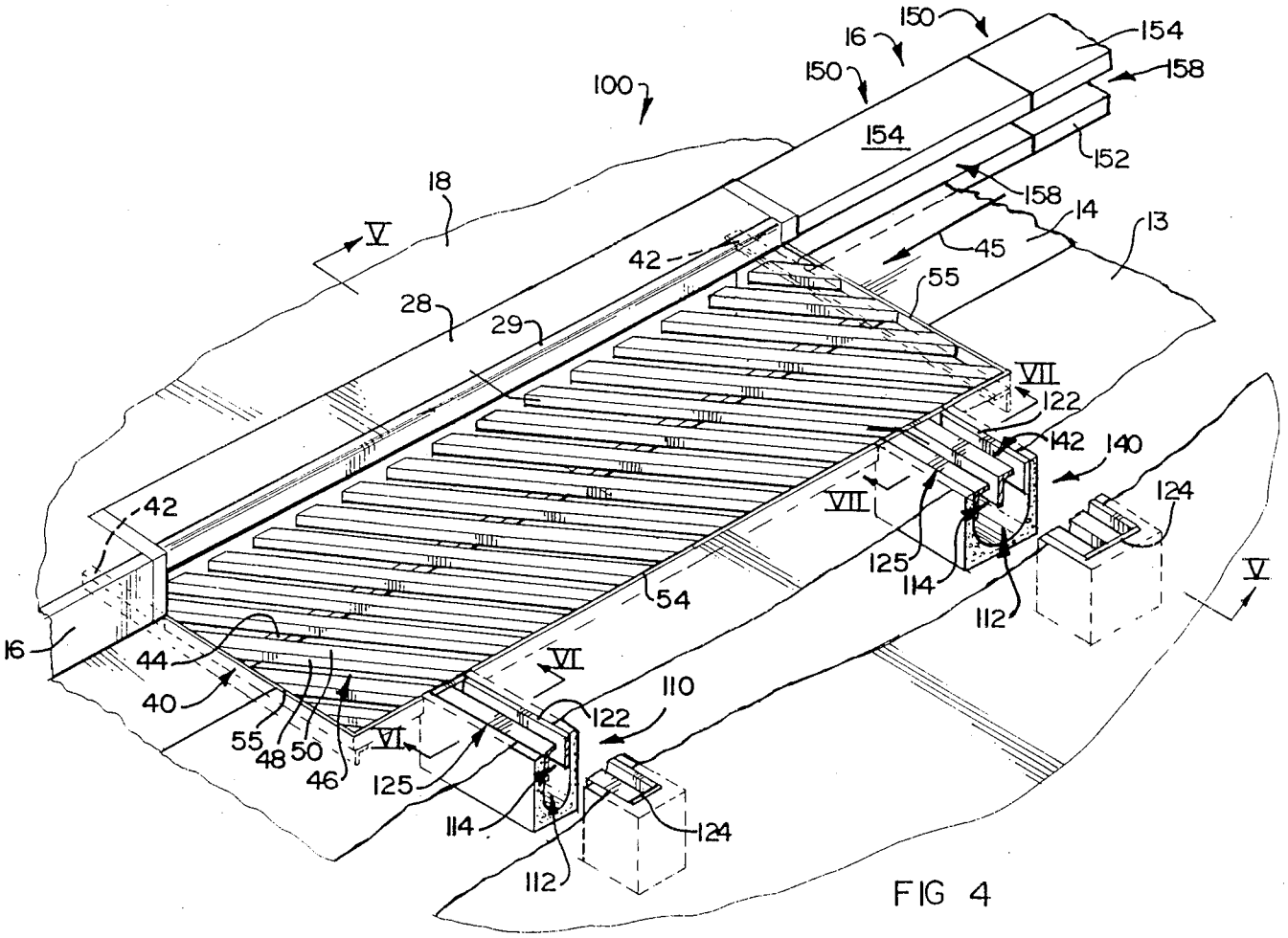
FIG. 4 shows a three-dimensional view of a roadway water drainage installation according to another embodiment of the second aspect of the invention.

Referring to FIGS. 1 to 3, reference numeral 10 generally indicates a roadway water drainage installation according to one embodiment of the second aspect of the invention.

The installation 10 includes a tarred or concrete roadway 12, with a concrete apron 14 extending alongside the roadway, and sloping downwardly away from the roadway. The apron 14 is hence at the same level as the road surface 13 along the line of abutment of the apron with the roadway. A curb 16 extends upwardly from the apron 14, and parallel to the roadway 12, up to the level of a pavement 18.

A subterranean storm water conduit or pipe (not shown) runs from a sump (not shown), and is located below the apron 14, the roadway 12 and the pavement 18.

A curb inlet device or unit 20, which can be precast from concrete, is also provided. The unit 20 includes a base 22, and spaced parallel sides 24, 26 extending upwardly from the base 22. The base 22 and sides 24, 26 define between them a water catchment zone 19. The side 26 extends up to the level of the pavement 18 and has an overhang or lip 28 fitted with a protective wear plate 29. The unit 20 hence provides an opening 30 in the apron 14, as well as an opening 32 in the curb 16. Two recesses 34 are provided in the side 26 of the unit, while an elongate recess 36, defining a shoulder, extends along the side 24. The base 22 is located above the sump and has an opening 23 through which water can pass from the unit 20 into the sump, and from there into the subterranean water or storm water pipe. Typically, the opening 23 is rectangular, having dimensions of about 0.45 m by 1.0 m.

The installation 10 also includes a grid device, generally indicated by reference numeral 40. The grid device 40 comprises two elongate transverse supports 42 extending parallel to each other, as well as orthogonally to the curb 16. The inner ends of the transverse member 42 nestle in the recesses 34, while their outer ends rest on the shoulder of the recess 36. The members 42 are lengths of angle iron to provide strength and rigidity.

An elongate support or bracing member 44 extends orthogonally to the transverse members 42, and is also a length of angle iron. If desired, at least one vertical support member 21 extending from the base 22 to the brace member 44 may be provided, as indicated in broken line in FIG. 2.

On top of the members 42, 44 are mounted a plurality of elongate water-deflecting members 46 in the form of lengths of angle iron. The members 46 extend at an angle of 45° to the curb 16, with planar portions 48 thereof extending uprightly. The other flanges or sides 50 of the members extend horizontally and are located uppermost, and face in the direction of water flowing in a direction as indicated by arrow 45, along a water pathway defined by the curb 16 and the apron 14. The members 46 are spaced apart.

The outer ends of the members 46 are secured to an elongate support 54 extending parallel to the curb 16. The support 54 is of flat iron, and further supports 55 are provided at its ends and extend orthogonally thereto.

If desired, the gap between the bracing member 44 and the outer ends of the members 46 is spanned by means of a cover or debris baffle plate 52.

While the components of the grid device 40 have been shown as being of metal, they can instead be of any suitable material, e.g. concrete or plastics material.

In use, water flowing along the pathway defined by the curb 16 and the apron 14 encounters the grid device 40. This water passes through the gaps between the sides or flanges 50 of the members 46 and impinges against their planar portions 48, thereby being urged or deflected by these planar portions, which extend at said angle of about 45° to the curb, to pass inwardly through the curb opening 32, as well as downwardly through the apron opening 30. Hence, the velocity of the water is used to channel or direct the water from the pathway into the water channel 19.

Referring to FIGS. 4 to 8, reference numeral 100 generally indicates a roadway water drainage installation according to another embodiment of the second aspect of the invention.

Parts of the installation 100 which are the same or similar to those of the installation 10, are indicated with the same reference numerals.

The opening 30 extends into the roadway 12 so that the grid device 40 of the installation 100 is somewhat wider than that of the installation 10.

The installation 100 includes two elongate roadway drainage members 110, 140. The drainage members 110, 140 are mouldings of cementitious material, e.g. concrete. Instead, they can, if desired, be of any other suitable material, e.g. metal and/or plastics material. The drainage member 110 comprises an elongate water channel 112 extending orthogonally to the curb 16, and located beneath the surface 13 of the roadway 12. An elongate downwardly directed inlet 114 leads into the channel 112. The inlet 114 is defined between a leading edge 116 and a trailing edge 118 of the drainage member. A grid device 120 is also provided. The grid device 120 comprises a component 122 located in the inlet 114 against the edge 116, end members 124, and a water-deflection member 125 in the form of a length of angle iron. The water-deflection member 125 comprises a component 126 located against the edge 118, with a planar component 128 protruding from the component 126 into the inlet. Hence, the components 128, 126 provide water-deflecting surfaces for deflecting water entering the gap 130 between the components 128, 122 downwardly into the channel 112.

The drainage member 140 is similar to the drainage member 110, except that its water channel 112, and inlet 114, are somewhat wider than those of the drainage member 110. The grid device 120 of the drainage member 140 includes a further water-deflection member 142 extending parallel to, and spaced from, the other water-deflection member 125. The water-deflection member 142 is similar to the water-deflection member 125. The drainage member 140 thus has two gaps 130 through which water can pass, and hence has a larger capacity than the drainage member 110. If desired, the water channel 112 can be still wider, and an even greater number of water-deflection members, spaced apart from one another, can then be provided.

It will be appreciated that usually only one of the drainage members 110, 140 will be used, with the drainage member 140 being used when greater capacity is required. The drainage member 100, 140 will also normally be located at the trailing end of the unit 20. Both drainage members 110, 140 have thus been shown in the drawings for ease of illustration.

The installation 100 also includes a plurality of elongate curb units 150 located end-to-end on the upstream side of the curb inlet device 20, with one curb unit 150 hence abutting against the device 20. The curb units 150 hence make up part of the curb 16

Each unit 150 comprises an elongate horizontally extending base portion 152 located at the level of the apron 14, an elongate horizontally extending top portion 154 spaced from the base portion being at the same level as the lip 28 of the curb inlet device 20, and an elongate connection portion 156, connecting the base portion to the top portion. An elongate recess 158 is hence defined between the portions 152, 154 and 156, with one end of the recess being in communication with the inside of the device 20, and hence the subterranean water channel 19. The units 150 are precast from concrete.

Hence, in use, water flowing along the flow pathway 20 will enter the channel 19 through the openings of the grid device 40, as well as through the curb opening 32. Some water will enter the recess 158 upstream of the device 20, with this water entering the channel 19 directly, i.e. not passing through the grid device 40 to a significant degree. Water flowing along the surface 13 of the roadway 12 will pass into the gaps 130 of the drainage members 100, 140, and into their channels 112. This water will flow along the channels 112 into the device 20.

The Applicant believes that the grid device 40 (without the cover plate 52), in which the water flowing along the pathway is directed both downwardly as well as obliquely inwardly along the full lengths of the members 46, will result in good water drainage, especially at high loads, e.g. during severe storms.

It is envisaged that the grid device 40 which incorporates the cover plate 52 will be used when somewhat lower capacity is acceptable but a higher debris load is expected, since debris in the water cannot pass vertically downwardly through the grid device 40 at the outer ends of the members 46, but passes along the members 46 to be swept off the inner ends of the members 46, thus reducing the likelihood of clogging.

In addition, the inside of the unit 20 can easily be cleaned merely by removing the grid device 40.

The Applicant believes that the drainage members 110, 140 provide an effective means of draining water from a roadway surface 12 alongside a curb inlet unit 20. The grid devices 120 of the drainage members 100, 140 are removable to permit the channels 112 to be cleaned. In other versions, they can, however, be located fixedly in position. The wider grid device 40 assists in draining such water.

The Applicant further believes that the use of the grid device 40 provides improved hydraulic performance of the unit 20 as compared to known grids having rectangular openings, e.g. greater capacity or throughput for water flowing at super critical velocity along the pathway since it utilizes the water velocity to function, while being of desired strength. Furthermore, lower maintenance will be required, e.g. due to the lower degree of clogging experienced with the devices 40, while the devices 40 will also have a desired safety level, e.g. wheels of bicycles cannot readily enter the gaps between the water-deflecting members 46 since they do not extend parallel to the curb 16. It is further expected that installation costs will be no higher than, and possibly lower than, those of known grids, while maintenance costs are, as mentioned hereinbefore, expected to be lower. For example, installation costs can be lower than with known grids since a shorter grid-like device 40, requiring less constructional material, can be used due to the improved hydraulic performance. It is also expected that due to the construction of the device 40, it will be possible to install it more rapidly than known grids, thereby also reducing installation costs.

We claim:

1. A grid device locatable in the apron opening of a roadway water drainage system comprising:

a roadway;

an elevated pavement extending alongside the roadway;

an apron extending alongside the roadway so that it is located between the roadway and the pavement at the level of the roadway;

a curb extending upwardly from the apron to the pavement so that the apron and curb define between them a water pathway;

a storm water conduit running below the pavement and/or the apron and/or the roadway; and a curb inlet device comprising an opening in the apron as well as an opening in the curb, with the openings being in communication with each other and with the device being connected to the storm water conduit such that water can pass from the water pathway, through the openings into the storm water conduit, the grid device comprising:

an elongate support; and a plurality of elongate water deflecting members spaced apart along the support and protruding therefrom so that they extend parallel to one another as well as at an obtuse angle to the support, with each member having a planar primary water deflecting surface which extends at said obtuse angle to the support, so that the primary water deflecting surfaces hence extend parallel to one another, as well as a planar secondary water deflecting surface extending transversely to the primary water deflecting surface, so that all the secondary water deflecting surfaces lie in the same plane.

2. A grid device according to claim 1, wherein the obtuse angle which the primary water deflecting surfaces form with the support is between 110° and 160°, and wherein the secondary water deflecting surfaces extend at right angles to the primary water deflecting surfaces.

3. A grid device according to claim 2, which includes a further or second elongate support to which the water deflecting members are mounted, the further or second elongate support being spaced from the other or first support; and a cover plate spanning the gap between the supports and the operatively undersides of the water deflecting members, so that water entering the gaps between the water deflecting members will pass along the cover plate away from the first support towards the free ends of the water deflecting members which are free of any support.

4. A roadway drainage installation, which comprises:

a roadway;

an elevated pavement extending alongside the roadway;

an apron extending alongside the roadway so that it is located between the roadway and the pavement at the level of the roadway;

a curb extending upwardly from the apron to the pavement so that the apron and curb define between them a water pathway;

a subterranean water channel running below the pavement and/or the apron and/or the roadway;

a curb inlet device comprising an opening in the apron as well as an opening in the curb, with the openings being in communication with each other and leading into the water channel so as to provide access from the water pathway to the water channel; and a grid device located in the apron opening, with the grid device comprising an elongate support; and a plurality of elongate water deflecting members spaced apart along the support and protruding therefrom so that they extend parallel to one another as well as at an obtuse angle to the support, with each member having a planar primary water deflecting surface which extends at said obtuse angle to the support, so that the primary water deflecting surfaces hence extend parallel to one another, as well as a planar secondary water deflecting surface extending transversely to the primary water deflecting surface, so that all the secondary water deflecting surfaces lie in the same plane.

5. An installation according to claim 4, wherein the obtuse angle which the primary water-deflecting surfaces form with the support is between 110° and 160°, and wherein the secondary water deflecting surfaces extend at right angles to the primary water deflecting surfaces.

6. An installation according to claim 5, which includes:

a plurality of spaced transverse supports protruding from the elongate support, with the water-deflecting members being mounted to the transverse supports and the inner or free ends of the transverse supports located on components of the channel;

a further or second elongate support extending alongside and spaced from the other or first elongate support, and on which the water-deflecting members are also mounted; and a cover plate spanning the undersides of the water-deflecting members between the elongate supports so that the free ends of the water deflecting members which protrude into the curb inlet opening are free of any support or the cover plate, to permit debris to pass freely over said ends of the members.

7. An installation according to claim 4, which includes an elongate drainage member extending transversely to the water pathway, the drainage member comprising an elongate water channel leading into the curb inlet device and located below the roadway surface; an inlet to the water channel through which water passing along the roadway surface can enter into the water channel with this water then flowing along the water channel into the curb inlet device and hence into the storm water conduit, with the inlet to the water channel extending along substantially the entire length of the water channel and being defined between a leading edge of the drainage member which water flowing along the roadway surface will encounter first, and a trailing edge spaced from the leading edge; and a water deflecting device in the inlet to the water channel, the water deflecting device comprising a lip protruding from the trailing edge so as to span a portion of the inlet, and a planar component protruding from the lip into the inlet, with the undersurface of the lip providing a planar water deflecting surface, as well as the planar component providing a planar water deflecting surface, for deflecting water entering the inlet downwardly to the channel.

8. An installation according to claim 4, which includes an elongate recess in, and extending along, the curb, the one end of the recess being in communication with the curb opening and the recess being located at the level of the apron such that some water flowing along the pathway will enter the recess flow along the recess, and be discharged from the recess into the water channel.

9. A roadway water drainage installation, which comprises:

a roadway;

an elevated pavement extending alongside the roadway;

an apron extending alongside the roadway so that it is located between the roadway and the pavement at the level of the roadway;

a curb extending upwardly from the apron to the pavement so that the apron and the curb defined between them a water pathway;

a storm water conduit running below the pavement and/or the apron and/or the roadway;

a curb inlet device comprising an opening in the apron as well as an opening in the curb, with the openings being in communication with each other and with the device being connected to the storm water conduit such that water can pass from the water pathway through the openings into the storm water conduit;

a grid device located within the apron opening; and an elongate drainage member comprising an elongate water channel leading into the curb inlet device and located below the roadway surface; an inlet to the water channel through which water passing along the roadway surface can enter into the water channel with this water then flowing along the water channel into the curb inlet device and hence into the storm water conduit, with the inlet to the water channel extending along substantially the entire length of the water channel and being defined between a leading edge of the drainage member which water flowing along the roadway surface will encounter first, and a trailing edge spaced from the leading edge; and a water deflecting device in the inlet to the water channel, the water deflecting device comprising a lip protruding from the trailing edge so as to span a portion of the inlet, and a planar component protruding from the lip into the inlet, with the undersurface of the lip providing a planar water deflecting surface, as well as the planar component providing a planar water deflecting surface, for deflecting water entering the inlet downwardly to the channel.

10. An installation according to claim 9, which includes an elongate recess in, and extending along, the curb, the one end of the recess being in communication with the curb opening and the recess being located at the level of the apron such that some water flowing along the pathway will enter the recess, flow along the recess and be discharged from the recess into the curb inlet device.

11. A roadway water drainage installation, which comprises:

a roadway;

an elevated pavement extending alongside the roadway;

an apron extending alongside the roadway so that it is located between the roadway and the pavement at the level of the roadway;

a curb extending upwardly from the apron to the pavement so that the apron and the curb defined between them a water pathway;

a storm water conduit running below the pavement and/or the apron and/or the roadway;

a curb inlet device comprising an opening in the apron as well as an opening in the curb, with the openings being in communication with each other and with the device being connected to the storm water conduit such that water can pass from the water pathway through the openings into the storm water conduit;

a grid device located within the apron opening; and an elongate recess in, and extending along, the curb, the one end of the recess being in communication with the curb opening and the recess being located at the level of the apron such that some water flowing along the pathway will enter the recess, flow along the recess, and be discharged from the recess into the curb inlet device.

* * * * *

UNITED STATES PATENT AND TRADEMARK OFFICE

CERTIFICATE OF CORRECTION

PATENT NO. : 4,986,693

DATED : January 22, 1991

INVENTOR(S) : David B. Salberg and Albert Rooseboom

It is certified that error appears in the above-identified patent and that said Letters Patent is hereby corrected as shown below:

On the title page, under the Foreign Application Priority Data, please change "Saudia Arabia" to --South Africa--, both occurrences.

Signed and Sealed this

Eighteenth Day of August, 1992

*Attest:*

DOUGLAS B. COMER

*Attesting Officer*

*Acting Commissioner of Patents and Trademarks*